US005918544A

United States Patent [19]

Doyle

[11] Patent Number: 5,918,544

[45] **Date of Patent: *Jul. 6, 1999**

[54] CLEANER FOR PRINTING DEVICES HAVING MEANS TO DISENGAGE WEB FROM FLUID SOURCE

[75] Inventor: Dennis G. Doyle, Worcester, Mass.

[73] Assignee: MPM Corporation, Franklin, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/632,839

[22] Filed: Apr. 16, 1996

[51] Int. Cl.[6] ..... B41F 35/00

[52] U.S. Cl. ..... 101/424; 101/423; 399/352

[58] Field of Search ..... 101/423, 424, 101/425; 355/300; 15/256.53; 399/352

[56] References Cited

U.S. PATENT DOCUMENTS

| | | | |
|---|---|---|---|
| 2,525,982 | 10/1950 | Wescott | 101/425 |
| 4,586,433 | 5/1986 | Jaffa et al. | 101/123 |
| 4,911,074 | 3/1990 | Simila | 101/425 |
| 4,922,821 | 5/1990 | Nozaka et al. | 101/425 |
| 4,953,252 | 9/1990 | Akisawa | 15/308 |
| 4,991,507 | 2/1991 | Nozaka et al. | 101/425 |
| 5,012,739 | 5/1991 | Loos et al. | 101/425 |
| 5,069,128 | 12/1991 | Hara et al. | 101/425 |
| 5,325,779 | 7/1994 | Ebina | 101/423 |
| 5,331,891 | 7/1994 | Sugiyama et al. | 101/424 |
| 5,367,955 | 11/1994 | Hara et al. | 101/424 |
| 5,519,914 | 5/1996 | Egan | 355/300 |

FOREIGN PATENT DOCUMENTS

| | | |
|---|---|---|
| 2804801A1 | 8/1979 | Germany . |
| 3736397A1 | 5/1989 | Germany . |
| 3825305A1 | 2/1990 | Germany . |
| 62-152853 | 7/1987 | Japan . |
| 2189435 | 10/1997 | United Kingdom . |

*Primary Examiner*—Edgar Burr
*Assistant Examiner*—Leslie Grohusky
*Attorney, Agent, or Firm*—Mintz, Levin, Cohn, Ferris Glovsky and Popeo, P.C.

[57] ABSTRACT

Web displacing apparatus selectively displaces a web between a first position engaging a fluid source and a second position spaced from the fluid source. A web drive is constructed and arranged to move the web in a direction from the fluid source toward a surface for engagement with the web for receiving fluid carried by the web from the fluid source. Web moving structure is constructed and arranged to selectively move the web between the first and second positions.

6 Claims, 2 Drawing Sheets

CLEANER FOR PRINTING DEVICES HAVING MEANS TO DISENGAGE WEB FROM FLUID SOURCE

Figure 1:
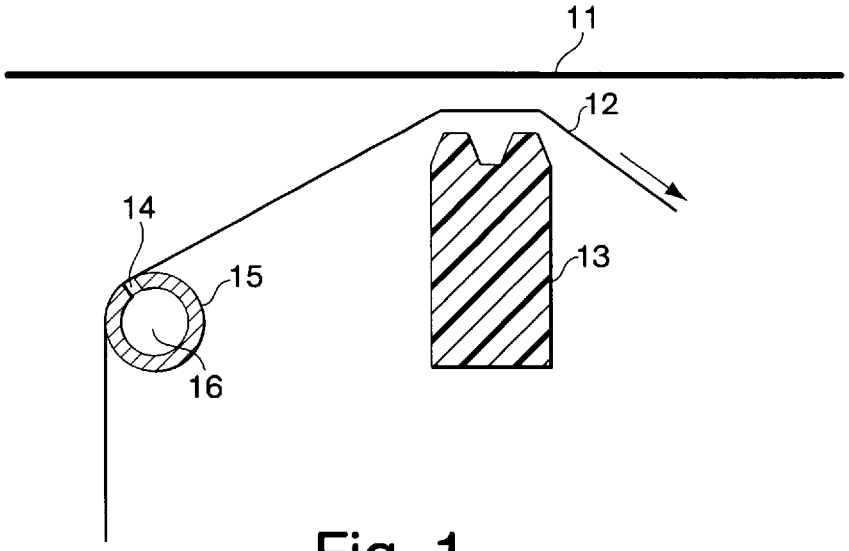
Fig. 1 (Prior Art)

The present invention relates in general to web displacing and more particularly concerns novel apparatus and techniques for displacing a fluid-absorbing web typically used for contacting a surface, such as a screen or stencil from a fluid source, such as a solvent tube to conserve on both fluid and web usages.

In high precision printing of inks, solder paste and other diverse media, a solvent-saturated wiper paper or cloth typically cleans the bottom side of the screen or stencil. According to one approach, a continuous wiper web of paper or cloth traverses a hollow solvent tube and a wiper blade. The wiper blade urges the solvent-saturated web into contact with the bottom side of the screen or stencil. The web receives solvent through a series of holes or slits located where the web is in tangential contact with the hollow solvent tube. A solvent pump delivers solvent under pressure to the inside of the solvent tube, forcing solvent through the series of holes or slots into the web in contact with the circumferential surface of the solvent tube.

The web absorbs solvent as it moves over the solvent tube while moving steadily. The solvent disperses uniformly along the width of the web by the time a wetted web portion reaches the wiper blade. During transition between dry and wet web portions, the transition region of the web may be two inches or more and produce relatively long cycle time and relatively large solvent and web consumption.

It is an important object of this invention, to reduce the time for completing a fluid wipe and conserve both fluid and web usage. According to the invention, there is a fluid source, such as a solvent tube, and web displacer constructed and arranged to separate the web from the fluid source in a first or off condition and allow the web to engage the fluid source in a second or on condition. Preferably during the off condition, the source refrains from furnishing fluid. Preferably during the on condition, the source furnishes fluid to the web.

According to a specific form of the invention, the web displacer comprises a structure coaxial about a fluid tube comprising the fluid source having a selectively engaging portion that displaces the web from the fluid tube during the off condition and allows the web to engage the fluid tube during the on condition, this structure typically being of arcuate cross section coaxial about the solvent tube. The web displacer may be connected to a web displacer linkage arm constructed and arranged for rotating the web displacer between the on and off positions. Preferably, there is a controller for controlling the movement of the web displacer to the on position when the fluid source is delivering fluid to the web through the tube and to the off position when the flow of fluid through the solvent tube is inhibited.

Figure 2:
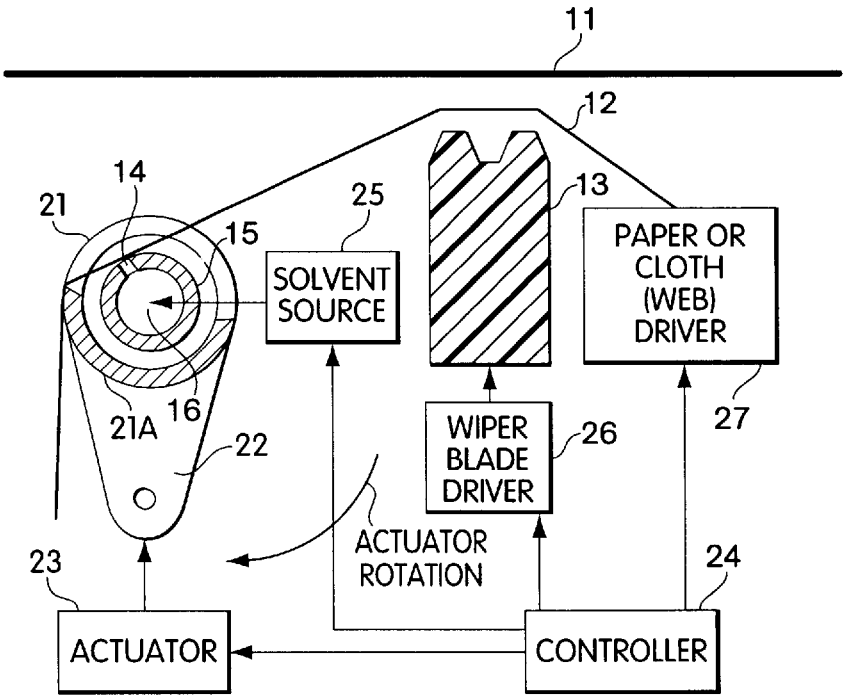
Figure 3:
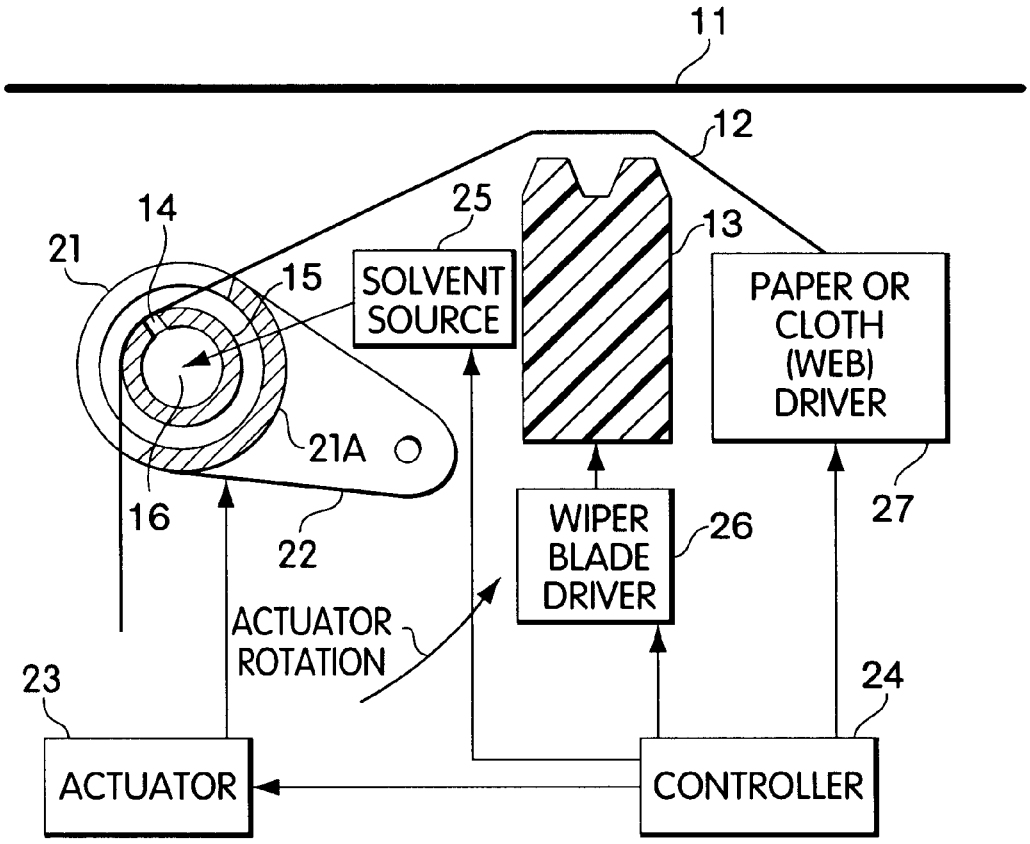

Numerous other features, objects and advantages of the invention will become apparent from the following description when read in connection with the accompanying drawings in which:

FIG. 1 is a diagrammatic representation of a prior art screen or stencil wiping system; and FIGS. 2 and 3 are combined block-diagrammatic representations of a system according to the invention in the off and on conditions, respectively.

With reference now to the drawings and more particularly FIG. 1, there is shown a diagrammatic representation of a typical prior art system for cleaning the bottom surface of a screen or stencil 11 with a solvent-saturated paper or cloth web 12 urged in contact with the bottom surface by wiper blade 13 after receiving solvent through holes or slots 14 in hollow solvent tube 15 that receives solvent under pressure in its central hollow region 16 typically from a solvent pump.

Referring to FIG. 2, there is shown a combined diagrammatic-block diagram of an exemplary embodiment of the invention in the OFF condition. The same reference symbols identify corresponding elements throughout the drawing. The invention includes a web displacer or lifter tube 21 having only an arcuate portion 21A coaxial about solvent tube 15. This arcuate portion 21A engages web when positioned as shown to position web spaced from openings in the OFF condition as shown. Web lifter tube 21 is connected to web lifter linkage arm 22 angularly displaced by actuator 23 in response to control signals from controller 24 for angular displacement between the OFF condition position shown in FIG. 2 and the ON condition shown in FIG. 3.

Solvent source 25, which typically includes a solvent pump, furnishes solvent under pressure to the hollow region 16 inside solvent tube 15 in response to control signals from controller 24. Wiper blade driver 26 extends and retracts wiper blade 13 in response to control signals from controller 24. Web driver 27 advances web 12 from left to right in response to control signals from controller 24.

Referring to FIG. 3, there is shown the apparatus of FIG. 2 with web lifter tube 21 and web lifter linkage arm in the ON condition with arcuate portion 21A angularly displaced counterclockwise to allow web 12 to engage solvent tube 15 and receive solvent through openings 14.

Having described the structural arrangement of a system according to the invention, its mode of operation will be described. Referring first to FIG. 2, controller 24 sends signals to actuator 23 and solvent source 25 positioning web lifter linkage arm 22 and web lifter tube 21 as shown such that the leading edge of the arcuate portion 21A has lifted web 12 from solvent tube 15 while inhibiting solvent source 25 from delivering solvent to the hollow region 16 of solvent tube 15, thereby creating an even transition from a saturated to a dry state as web 12 moves from the concentric web lifter and solvent tubes 21 and 15 toward wiper blade 13. Controller 24 also delivers control signals to wiper blade driver 27 to selectively press web 12 against the bottom surface of the screen or stencil 11 and to web driver 27 to effect movement of web 12 from left to right when cleaning is desired. Then web 12 continuously moves with wiper blade 13 urging web 12 against the bottom surface of screen or stencil 11.

Referring to FIG. 3, controller 24 furnishes control signals to actuator 23 and solvent source 25 causing web lifter tube 21 to rotate counterclockwise to the position shown and to solvent source 25 causing delivery of solvent under pressure to the internal region 16 of solvent tube 15. In this ON condition, web 12 is clear of arcuate portion 21A and engages solvent tube 15 to receive solvent through openings 14 to create an even transition from a dry to a saturated state as web 12 moves from the coaxial assembly of solvent tube 15 and web lifter tube 21 toward wiper blade 13.

The invention has a number of advantages. The transition between saturated and dry web portions is substantially instantaneous. During a wipe, the invention reduces solvent consumption, web consumption and cycle time because there is no dwell time waiting for a worst case, nonuniform, transition point in the web to pass by the wiper blade before continuing the wiping process. At the beginning of a wipe, consumption is also reduced because there is an exceptionally short priming time because solvent is not unnecessarily wicked from the solvent tube.

Other embodiments are within the claims.

What is claimed is:

1. Web displacing apparatus for selectively displacing a web between a first position in which it engages and receives fluid from a fluid source and a second position in which the web is spaced from and does not receive fluid from the source comprising:

a web driver for moving said web across said fluid source, a web displacer for selectively moving said web between said first position engaging said fluid source and said second position spaced from said fluid source, a controller for causing fluid to be transferred to said web from said fluid source when said web is in said first position and preventing flow of fluid from said fluid source when said web is in said second position simultaneously with controlling movement of said web displacer between said first and second positions, a wiper blade, and a wiper blade driver for urging said wiper blade against said web to maintain said web in contact with a surface when said web is moving.

2. Apparatus in accordance with claim 1 wherein said fluid source comprises a hollow tube formed with openings in its circumference for transferring fluid from the hollow region inside said tube to said web when said web is in said first position.

3. Web displacing apparatus for selectively displacing a web between a first position in which it engages and receives fluid from a fluid source and a second position in which the web is spaced from and does not receive fluid from the source comprising:

a web driver for moving said web across said fluid source, a web displacer for selectively moving said web between said first position engaging said fluid source and said second position spaced from said fluid source, a controller for causing fluid to be transferred to said web from said fluid source when said web is in said first position and preventing flow of fluid from said fluid source when said web is in said second position simultaneously with controlling movement of said web displacer between said first and second positions, and wherein said web displacer comprises a lifter tube having an arcuate section concentric about said fluid source and an empty portion so that the arcuate section allows said web to engage said fluid source in said first position and engages said web in said second position with the web spaced from said fluid source.

4. Apparatus in accordance with claim 3 wherein said fluid source comprises a hollow tube formed with openings in its circumference for transferring fluid from the hollow region inside said tube to said web when said web is in said first position.

5. Apparatus in accordance with claim 3 and further comprising, a web displacer driver coupled to said controller for selectively angularly displacing said lifter tube between first and second angular positions corresponding to said first and second positions respectively.

6. Apparatus in accordance with claim 5 and further comprising, a wiper blade, and a wiper blade driver for urging said wiper blade against said web to maintain said web in contact with a surface when said web is moving.

* * * * *